United States Patent [19]

White

[11] 4,444,086

[45] Apr. 24, 1984

[54] MISSILE AZIMUTH AIMING APPARATUS

[75] Inventor: Harold V. White, Huntsville, Ala.

[73] Assignee: The United States of America as represented by the Secretary of the Army, Washington, D.C.

[21] Appl. No.: 333,583

[22] Filed: Dec. 23, 1981

[51] Int. Cl.[3] ..... F41G 3/02

[52] U.S. Cl. ..... 89/1.8; 244/3.1

[58] Field of Search ..... 89/1.8, 1.815; 244/3.1

[56] References Cited

U.S. PATENT DOCUMENTS 3,941,345 3/1976 Stripling et al. ..... 244/3.1

3,955,468 5/1976 Romilly ..... 89/1.8

*Primary Examiner*—Charles T. Jordan

*Attorney, Agent, or Firm*—Robert P. Gibson; Anthony T. Lane; Harold W. Hilton

[57] ABSTRACT

Apparatus for fast, accurate aiming of a missile from a launch vehicle. The apparatus permits fast accurate aiming of a missile inertial measurement unit for cases in which the inertial measurement unit does not possess required performance capability for self-aiming. The apparatus involves no optical link and is not expended with the missile.

5 Claims, 3 Drawing Figures

MISSILE AZIMUTH AIMING APPARATUS

DEDICATORY CLAUSE

The invention described herein may be manufactured, used, and licensed by or for the Government for governmental purposes without the payment to me of any royalties thereon.

BACKGROUND OF THE INVENTION

Some modern missile systems utilize on board aiming devices such as a strapdown inertial measurement unit (IMU). Typically, the inertial measurement unit is comprised of three gyros and three accelerometers with electronics (including a computer) to define and maintain a reference coordinate system from which velocity and position can be derived. However, unless an extremely accurate vertical gyro is utilized, accurate self-contained alignment of strapdown inertial measurement units cannot be realized without some form of augmentation such as indexing the inertial measurement unit, or as a minimum, indexing the vertical gyro through either 90 degrees or 180 degrees for determining short term gyro drift, i.e., the gyro is calibrated just prior to using it for azimuth heading determination. An extremely accurate vertical gyro or an augmentation technique, in general, adds cost and complexity to a unit which is ultimately expended.

It is therefore, an object of the present invention to provide apparatus for fast, accurate azimuth aiming of a strapdown inertial measurement unit on board a missile.

It is a further object of the present invention to provide such apparatus as part of a launch vehicle, and therefore, is not expended with the missile but is used repeatedly with each reload.

SUMMARY OF THE INVENTION

Apparatus for fast, accurate aiming of a strapdown inertial measurement unit carried on board a missile. The apparatus includes a gyrocompass mounted on a retract mechanism carried on board a launch vehicle. The gyrocompass is provided with a reference surface for intimate contact with a precision surface provided on the inertial measurement unit. The retract mechanism retracts the gyrocompass just prior to launch of the missile.

DESCRIPTION OF THE PREFERRED EMBODIMENT

Figure 1:
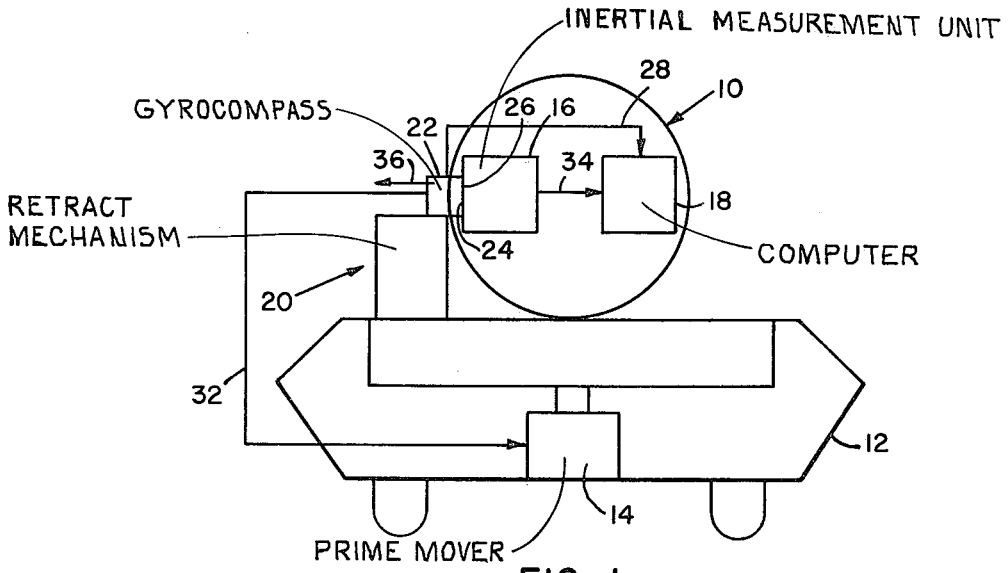
FIG. 1 is an end elevational view of a missile carried on a launch vehicle and the azimuth aiming apparatus of the present invention.

As seen in FIG. 1, a missile 10 is mounted on a launch vehicle 12 prior to launching. The launch vehicle includes a prime mover 14 for positioning the missile by rotating the launcher on the vehicle to target azimuth.

Carried on board the missile 10 is the inertial measurement unit generally designated at 16 and a computer 18. Carried on board the launch vehicle 12 is a retract mechanism 20 having a gyrocompass 22 secured thereto.

Gyrocompass 22 is meshed with the inertial measurement unit 16 via precision surface 24 on the inertial measurement unit 16 and reference surface 26 on the gyrocompass. This mechanical contact precludes the optical transfer of azimuth heading data.

The gyrocompass 22 can be designed to operate well before a launch if power is available. In the event no power is allowed to the system prior to a countdown, gyrocompass 22 can be designed for quick reaction time, e.g., 3 to 5 minutes. The gyrocompass 22 design can be optimized to provide the required accuracy based on reaction time allowed, and environmental considerations such as temperature and launcher motion. Typical gyrocompass 22 implementations are (1) the pendulous type with an automatic bias adjustment about the pendulous axis with bias adjustment performed prior to gyro wheel run-up, and (2) a two-degree-of-freedom, dry, tuned gyro type with indexing capability for calibration.

The retract mechanism 20 allows the gyrocompass reference surface 26 to be brought into intimate contact with the inertial measurement unit precision surface 24. Mating of the surfaces must be accomplished in a minimum amount of time for fast reload purposes. The mating surfaces 24 and 26 can be smooth areas or, as another example, three feelers from the gyrocompass 22 can be made to bear upon the inertial measurement unit reference surface 24. The major element of the retract mechanism can be a hydraulic piston, electric motor or other means for decoupling the two surfaces.

Figure 2:
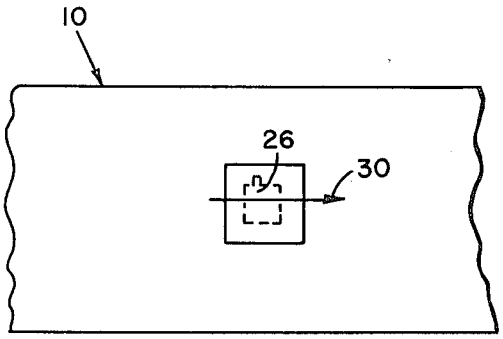
FIG. 2 is a side elevational view of the gyrocompass aiming surface and the downrange accelerometer input axis.
Figure 3:
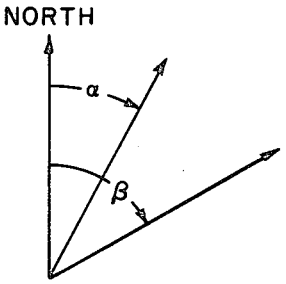
FIG. 3 is a diagrammatic view of the aiming angles for missile firing.

During prelaunch operations, the azimuth direction of an imaginary line on the gyrocompass reference surface 26 is determined by the gyrocompassing process. Gyrocompassing is the process of automatic North determination and is based on the principle that no component of earth's rate is sensed by a gyro when its input axis is oriented exactly east-west. The gyrocompass is calibrated such that the information supplied to the missile computer 18 via data link 28 conforms to the azimuth direction of the downrange accelerometer input axis 30 (see FIG. 2). The block to which the accelerometer is mounted contains the inertial measurement unit reference surface 24.

The gyrocompass determines the angle $\alpha$ of the reference surfaces 24 and 26 from north and consequently the azimuth heading of the accelerometer input axis 30. Angle $\beta$ is the known target heading from north. Angle $\beta-\alpha$ can be used to rotate the launcher to the target azimuth $\beta$, if desired, via data link 32 to the launcher prime mover 14. Otherwise, angle $\beta-\alpha$ is the input to the guidance and control computer 18 which stores a reference coordinate system derived from the (level axes) transmitted via data link 34 and the gyrocompass 22 (azimuth axis) transmitted via data link 28.

The first action in a firing sequence is to retract the gyrocompass 22 via the retract mechanism 20 in the direction of the arrow 36. The gyrocompass 22 can remain operational while reloading and perform a fine azimuth determination after remating the reference surface 26 with the inertial measurement unit 16 on board the new round.

I claim:

1. Apparatus for fast, accurate aiming of a missile positioned on a launch vehicle, said missile having a strapdown inertial measurement unit carried thereon, said apparatus comprising:

a. a retract mechanism supported on said launch vehicle;

b. a gyrocompass carried on said retract mechanism;

c. said strapdown inertial measurement unit having a precision surface thereon and said gyrocompass having a reference surface thereon for intimate contact therebetween;

d. said retract mechanism disposed for displacement for separation of said gyrocompass from said inertial measurement unit responsive to said gyrocompass acquiring the desired azimuth information.

2. Apparatus as in claim 1 wherein said launch vehicle is provided with a prime mover for positioning said missile to the proper target azimuth.

3. Apparatus as in claim 2 including a data link circuit connected between said prime mover and said gyrocompass to provide target information for said prime mover for proper positioning of said missile.

4. Apparatus as in claim 2 including a guidance and control computer carried on board said missile, second data link means connected between computer and said gyrocompass and third data link means connected between said inertial measurement unit and said computer, whereby said second data link means is disposed for transmitting azimuth information from said gyrocompass to said computer, and, said third data link means is disposed for transmitting reference coordinate information from said inertial measurement unit to said computer.

5. Apparatus as in claim 2 wherein said precision and reference surface are precision machined smooth surfaces.

* * * * *